US007922539B2

(12) United States Patent
Kubo

(10) Patent No.: US 7,922,539 B2
(45) Date of Patent: Apr. 12, 2011

(54) FLOATING CONNECTOR WITH AN IMPEDANCE ADJUSTING MEMBER

(75) Inventor: Akira Kubo, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 12/627,858

(22) Filed: Nov. 30, 2009

(65) Prior Publication Data

US 2010/0075536 A1 Mar. 25, 2010

Related U.S. Application Data

(63) Continuation of application No. PCT/JP2008/057657, filed on Apr. 21, 2008.

(30) Foreign Application Priority Data

May 30, 2007 (JP) ..... 2007-143519

(51) Int. Cl.
*H01R 13/66* (2006.01)

(52) U.S. Cl. ..... 439/620.21; 439/247

(58) Field of Classification Search ..... 439/620.21, 439/620.22, 620.12, 620.16, 247, 248
See application file for complete search history.

(56) References Cited

U.S. PATENT DOCUMENTS

| | | | | |
|---|---|---|---|---|
| 5,286,221 | A | 2/1994 | Fencl et al. | |
| 5,580,279 | A | 12/1996 | Belopolsky et al. | |
| 6,749,444 | B2 * | 6/2004 | Murr et al. | 439/79 |
| 6,939,154 | B2 * | 9/2005 | Horikoshi et al. | 439/247 |
| 7,186,126 | B2 * | 3/2007 | Umehara et al. | 439/247 |
| 7,517,232 | B2 * | 4/2009 | Yuan et al. | 439/79 |
| 2001/0044235 | A1 | 11/2001 | Cohen | |
| 2006/0061433 | A1 | 3/2006 | Matsumoto | |
| 2006/0258199 | A1 | 11/2006 | Umehara et al. | |

FOREIGN PATENT DOCUMENTS

| | | |
|---|---|---|
| JP | 02079583 U | 6/1990 |
| JP | 02291686 | 12/1990 |
| JP | 03156871 | 7/1991 |
| JP | 10270124 | 10/1998 |

OTHER PUBLICATIONS

International Search Report for International Application No. PCT/JP2008/057657, dated Apr. 30, 2008, 2 pages.

* cited by examiner

*Primary Examiner* — Hae Moon Hyeon
(74) *Attorney, Agent, or Firm* — Barley Snyder LLC

(57) ABSTRACT

A floating connector is provides that enables impedance matching in the entire contact without hindrance of the movement of a movable housing. The floating connector having a contact, a movable housing, a fixed housing, and an impedance adjusting member. The contact includes a contact portion to be mated with a mating contact, a board connecting portion to be connected to a circuit board, and a flexible coupling portion that is flexible and that couples the contact portion and the board connecting portion. The impedance adjusting member is arranged and receives the flexible coupling portion, which is formed in such a way to include a first curved portion, a second curved portion, and a linear coupling portion. The second curved portion bends in a reversed direction from a direction that the first curved portion bends, while the linear coupling portion connects the first curved portion and the second curved portion.

22 Claims, 13 Drawing Sheets

Prior Art

FLOATING CONNECTOR WITH AN IMPEDANCE ADJUSTING MEMBER

CROSS-REFERENCE TO RELATED APPLICATIONS

This application is a continuation of PCT International Application No. PCT/JP2008/057657, filed Apr. 21, 2008, which claims priority under 35 U.S.C. §119 to Japanese Patent Application No. JP 2007-143519, filed May 30, 2007.

FIELD OF THE INVENTION

The invention relates to an electrical connector, in particular, to a floating connector for connecting two circuit boards.

BACKGROUND

Conventionally, floating connectors are well known. For example, as a floating connector for use in interconnection of two circuit boards.

The floating connector 101, shown in FIG. 13, is provided with multiple metal contacts 110, a movable housing 120, and a fixed housing 130.

Each contact 110 is provided with a contact portion 111, a board connecting portion 112, and a flexible coupling portion 113. The contact portion 111 is configured to be in contact with a mating contact provided at a mating connector (not shown). The board connecting portion 112 is configured to be connected to a circuit board (not shown). The flexible coupling portion 113 connects the contact portion 111 and the board connecting portion 112.

Specifically, in the floating connector 101, the contact portion 111 of each contact 110 is received in and secured to each contact receiving passageway 121 of the movable housing 120, and in addition, the board connecting portion 112 of each contact 110 is secured to the fixed housing 130. Thus, the movable housing 120 is coupled to the fixed housing 130 through the flexible coupling portion 113 of the contact 110, so the movable housing 120 is stacked above the fixed housing 130 with spaced apart from the fixed housing 130 by a distance X.

In addition, according to the floating connector 101, when a mating connector is mated, the movable housing 120 moves in vertical and horizontal directions with respect to the fixed housing 130, thereby allowing a positional misalignment between the mating contact and the contact 110. Further, even if an object or the like hits the movable housing 120 and a strong impact is applied to the movable housing 120, the flexible coupling portion 113 of the contact 110 will absorb the impact and the impact will be attenuated. It is therefore possible to prevent fault at a solder connecting part of the board connecting portion 112.

It should be noted that, however, each contact 110 of the floating connector 101 includes the flexible coupling portion 113 that is formed by winding a metallic member. Accordingly, the conductor serving as a signal path is made longer and its self-impedance is made greater. Consequently, in each contact 110, the impedance of the flexible coupling portion 113 is greater than those of other portions, thereby causing an impedance mismatch in the signal path. Then, if the impedance mismatch is caused in the signal path of each contact 110, this will result in unnecessary signal reflections.

Accordingly, the known floating connector 101 has a problem in that electrical signals, flowing across each contact 110, are unstable. Such a problem becomes noticeable, in particular, when high-frequency electrical signals (for example, 1.5-3 GHz) are flow across each contact 110. In this case, the self-impedance generated at each contact 110, due to the provision of the flexible coupling portion 113, can be cancelled by arranging around each contact 110 a material with a dielectric constant greater than that of air so as to make the capacitor greater.

Conventionally, there has been known connectors, like the connector shown in FIG. 14, which is a connector for impedance matching in the entire contact.

The impedance matching connector 201, shown in FIG. 14, is provided with multiple signal terminals 210, multiple ground terminals 211, a connector main body 220, and a spacer 230 to be attached to the connector main body 220.

Each of the terminals 210 and 211 is provided with a contact portion 212 to be in contact with a mating contact provided at a mating connector (not shown), a board connecting portion 213 to be connected to a circuit board (not shown), and a lead portion 214 to couple the contact portion 212 and the board connecting portion 213.

The spacer 230 is made of a dielectric material and is formed to have a comb teeth shape.

Specifically, in the impedance matching connector 201, the contact portion 212 of each of the terminals 210 and 211 is received in and secured to each contact receiving passageway 221 of the connector main body 220. Additionally, the spacer 230 having a comb teeth shape is interposed between the lead portion 214 of each signal terminal 210 and the lead portion 214 of each ground terminal 211 extended from the connector main body 220.

The impedance matching connector 201 is configured such that the contact portion 212 of each of the terminals 210 and 211 is received in each contact receiving passageway 221 of the connector main body 220, and in addition, the spacer 230 is disposed with the lead portion 214 of each of the terminals 210 and 211 extended from the connector main body 220. Accordingly, almost the entire surface of each of the terminals 210 and 211 is surrounded by a dielectric material. This allows the impedance matching between the impedance of the contact portion 212 and that of the lead portion 214 in each of the terminals 210 and 211, thereby allowing the impedance matching in the entire of each of the terminals 210 and 211.

In order to match the impedances in the entire contact, it is desirable that a dielectric material should surround the entire contact extended from the housing, as in the impedance matching connector 201 shown in FIG. 14.

It should be noted that, however, the floating connector 101 shown in FIG. 13 has a certain configuration where the movable housing 120 moves in vertical and horizontal directions with respect to the fixed housing 130, since the flexible coupling portion 113 in each contact 110 is capable of flexible deformation. Therefore, if the floating connector 101 has a configuration where the entire of the flexible coupling portion 113 of each contact 110 is surrounded by a dielectric material, such a configuration will cause a problem of blocking the movement of the movable housing 120.

SUMMARY

An object of the present invention to provide a floating connector in which impedance matching is enabled in the entire contact without blocking the movement of a movable housing.

The floating connector includes a contact, a movable housing, a fixed housing, and an impedance adjusting member. The contact includes a contact portion to be mated with a mating contact, a board connecting portion to be connected to a circuit board, and a flexible coupling portion that is flexible and that couples the contact portion and the board connecting portion. The movable housing receives the contact portion of the contact therein, while the fixed housing secures the board connecting portion of the contact thereto. The movable housing is stacked over the fixed housing, with each being spaced apart from each other by a given distance. The impedance adjusting member is arranged and receives the coupling portion.

The flexible coupling portion is formed in such a way to have an S-shape. The flexible coupling portion includes a first curved portion, a second curved portion, and a linear coupling portion. The second curved portion bends in a reversed direction from a direction that the first curved portion bends, while the linear coupling portion connects the first curved portion and the second curved portion.

BRIEF DESCRIPTION OF THE DRAWINGS

Embodiments of the invention are described in greater detail in the following description and are shown in a simplified manner in the drawings, in which.

DETAILED DESCRIPTION OF THE EMBODIMENT(S)

Figure 1:
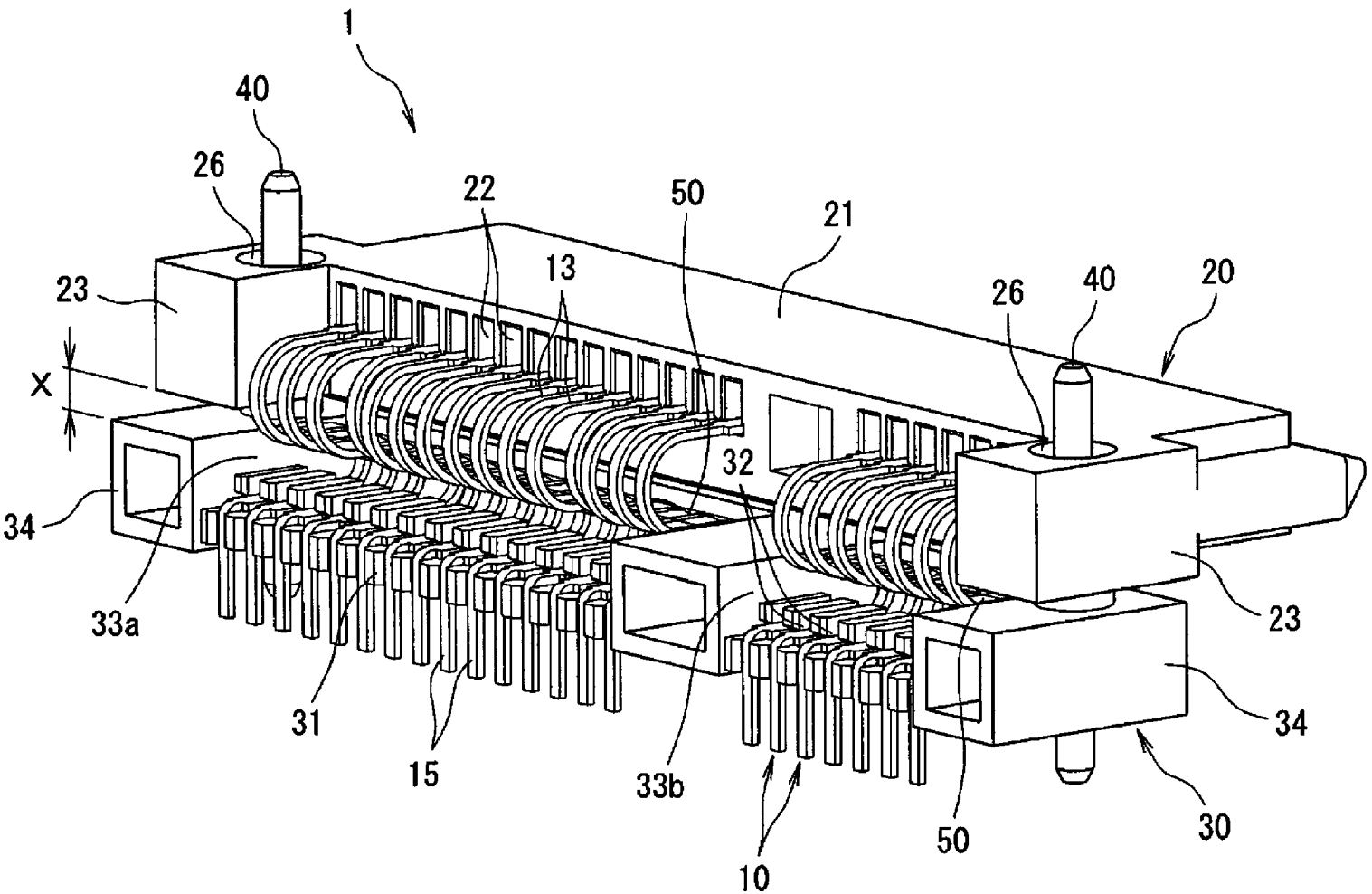
FIG. 1 is a perspective view of a floating connector according to the invention.
Figure 2:
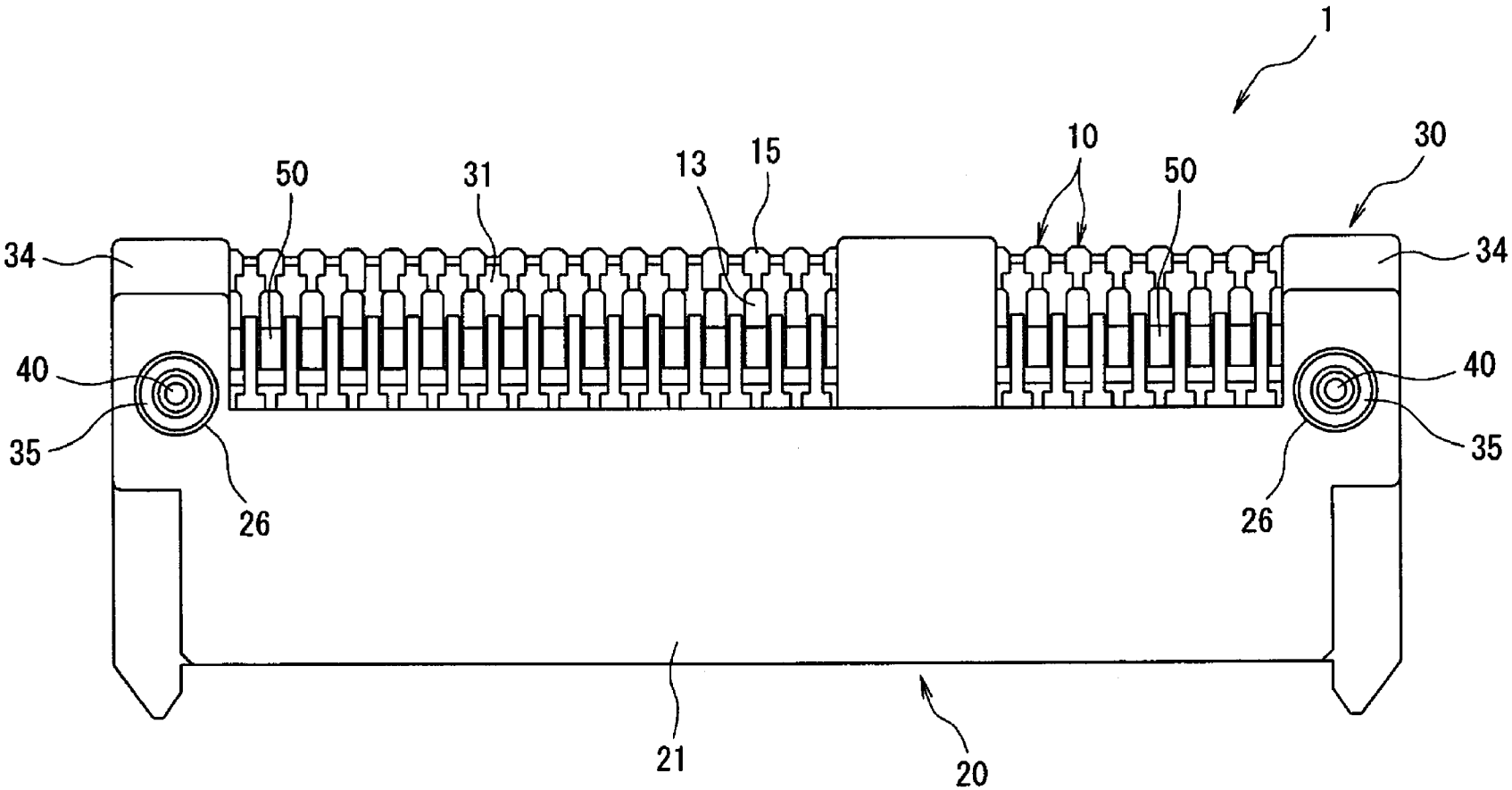
FIG. 2 is a plan view of the floating connector illustrated in FIG. 1.
Figure 3:
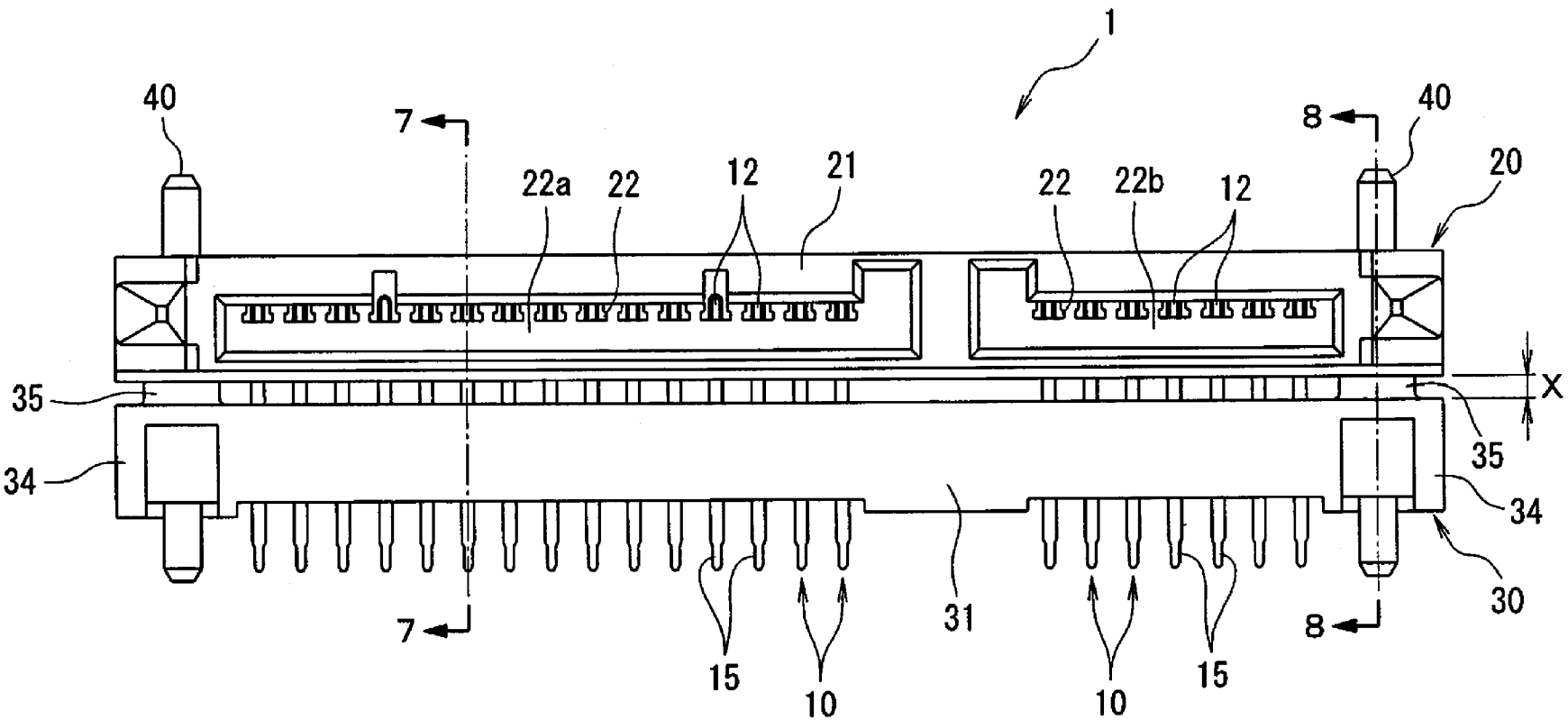
FIG. 3 is a front view of the floating connector illustrated in FIG. 1.
Figure 4:
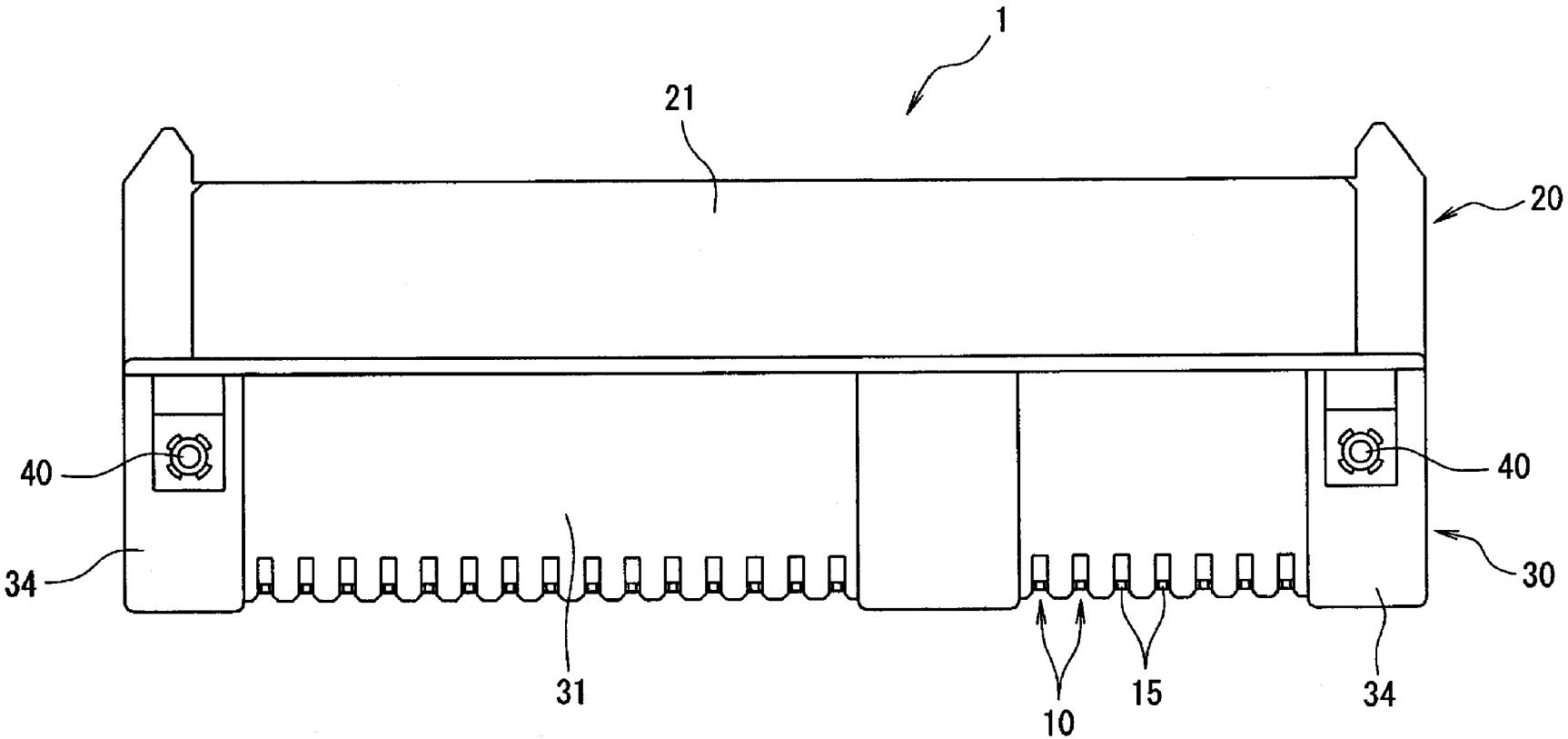
FIG. 4 is a bottom view of the floating connector illustrated in FIG. 1.
Figure 5:
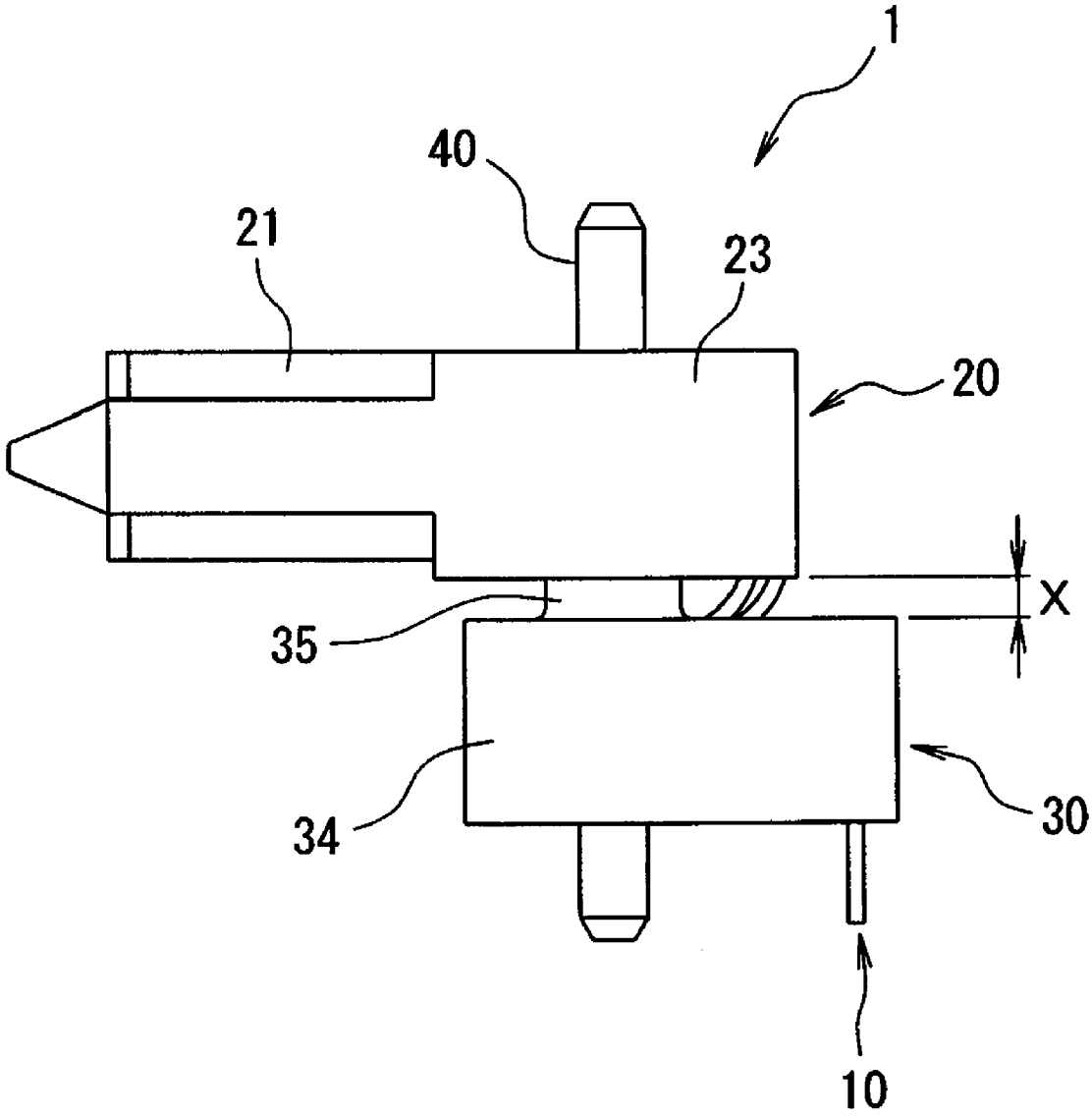
FIG. 5 is a right side view of the floating connector illustrated in FIG. 1.
Figure 6:
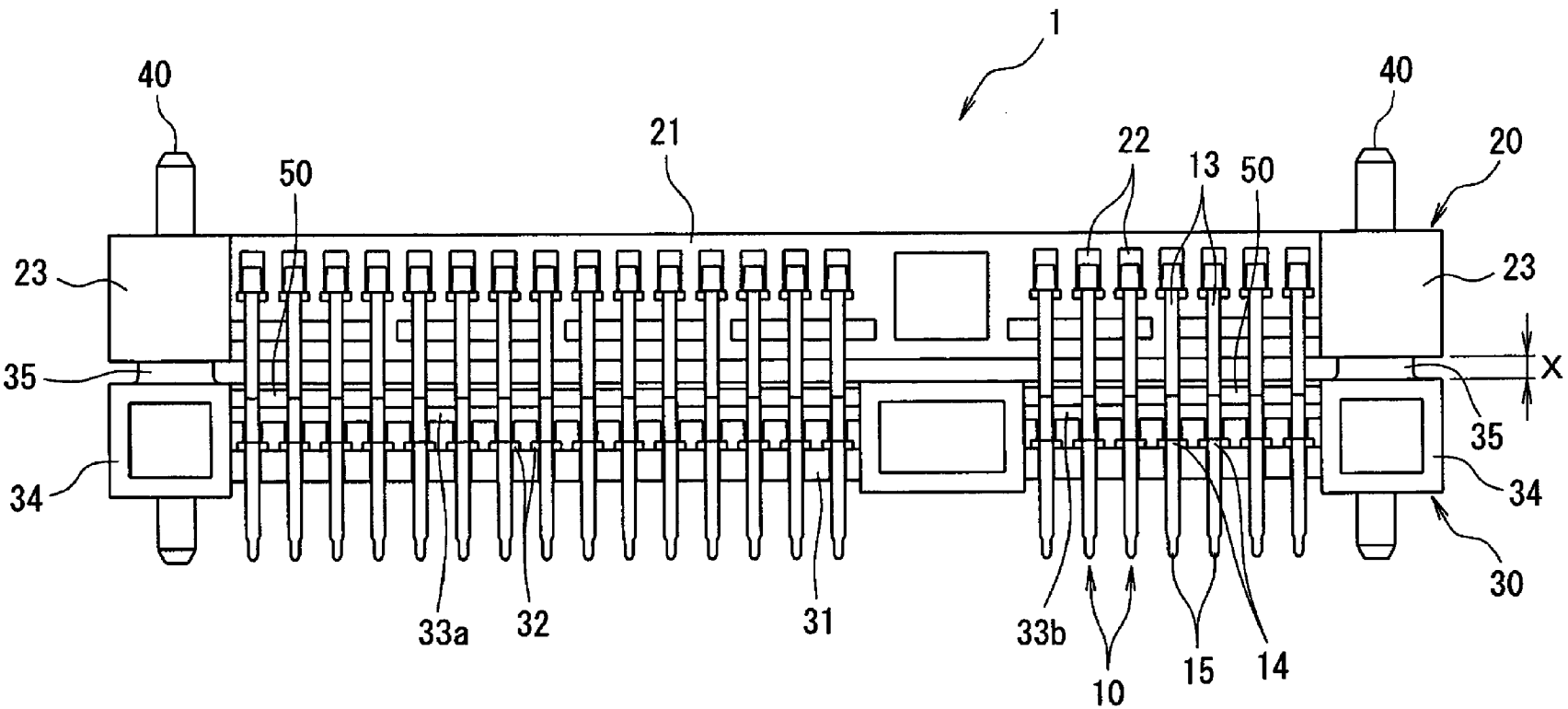
FIG. 6 is a rear view of the floating connector illustrated in FIG. 1.

Hereinafter, embodiments of the invention will be described with reference to the drawings.

A floating connector 1, as illustrated in FIG. 1 to FIG. 6, is provided with multiple metal contacts 10, an impedance adjusting member 50, an insulating movable housing 20, an insulating fixed housing 30; and a pair of pin 40.

Referring to FIG. 7 through 10, each contact 10 is provided with a first secured portion 11 secured to the movable housing 20, and a contact portion 12 that extends forward from the first secured portion 11 (to the left side of FIG. 7, to the far right side of FIG. 10) to make contact with a mating contact provided at a mating connector (not shown). Also, each contact 10 is provided with a flexible coupling portion 13, a second secured portion 14, and a board connecting portion 15. The flexible coupling portion 13 is configured such that it is flexible and that extends rearward from the first secured portion 11. The second secured portion 14 is configured such that it is arranged at the rear end of the flexible coupling portion 13 and that is secured at the fixed housing 30, while the board connecting portion 15 firstly extends rearward from the second secured portion 14 and then extends downward to be connected to a circuit board (not illustrated). Each contact 10 is formed by stamping and forming sheet metal.

Figure 10:
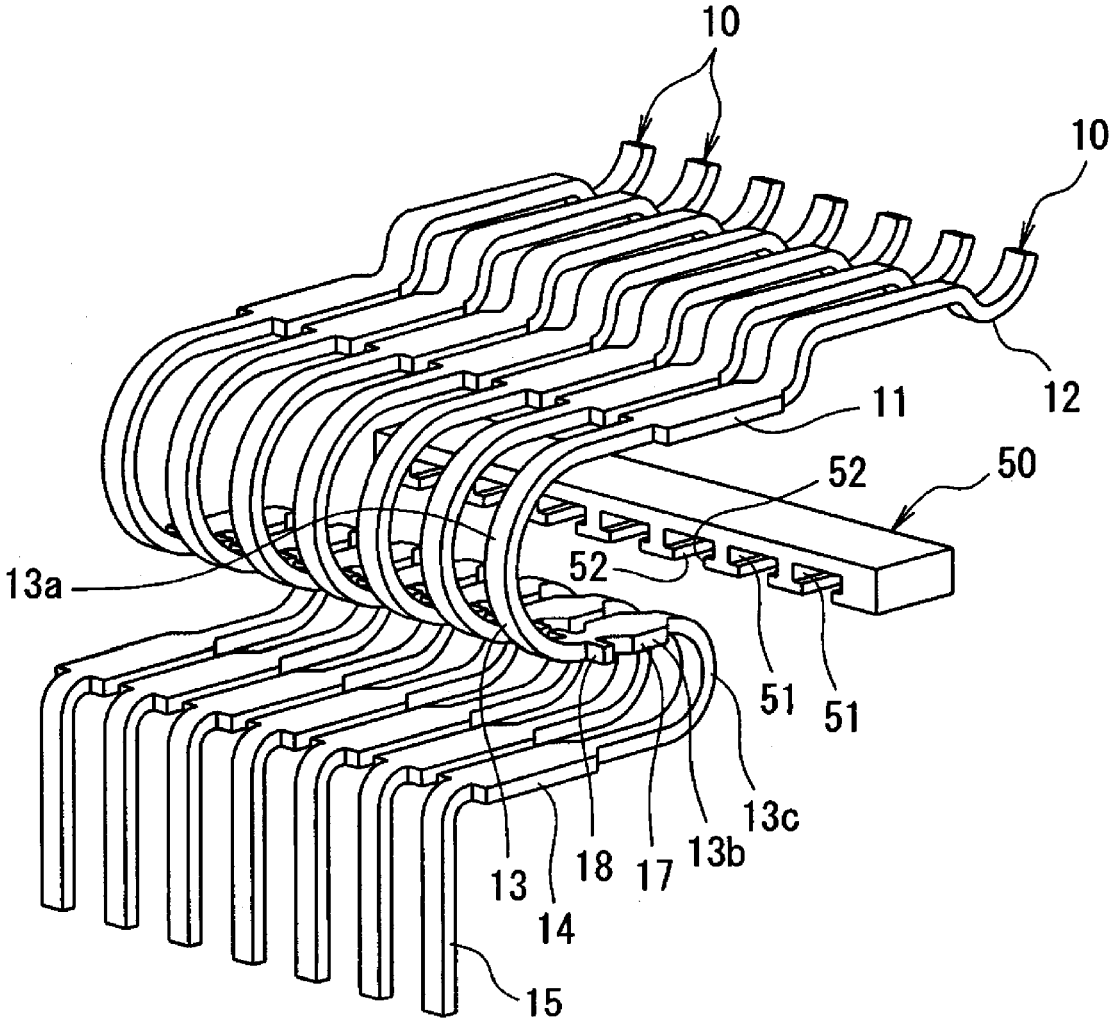
FIG. 10 is a perspective view of contacts and an impedance adjusting member included in the floating connector according to the invention.

Referring now to FIG. 10, the flexible coupling portion 13 is provided with a first curved portion 13*a* that curves to linearly extend rearward from the first secured portion 11 and then folds back, a coupling portion 13*b* that linearly extends frontward from the first curved portion 13*a*, and a second curved portion 13*c* that curves from the coupling portion 13*b* in a reversed direction from the direction that the first curved portion 13*a* curves, and then linearly extends rearward. In this manner, the flexible coupling portion 13 is formed to have an S-shape.

Figure 11:
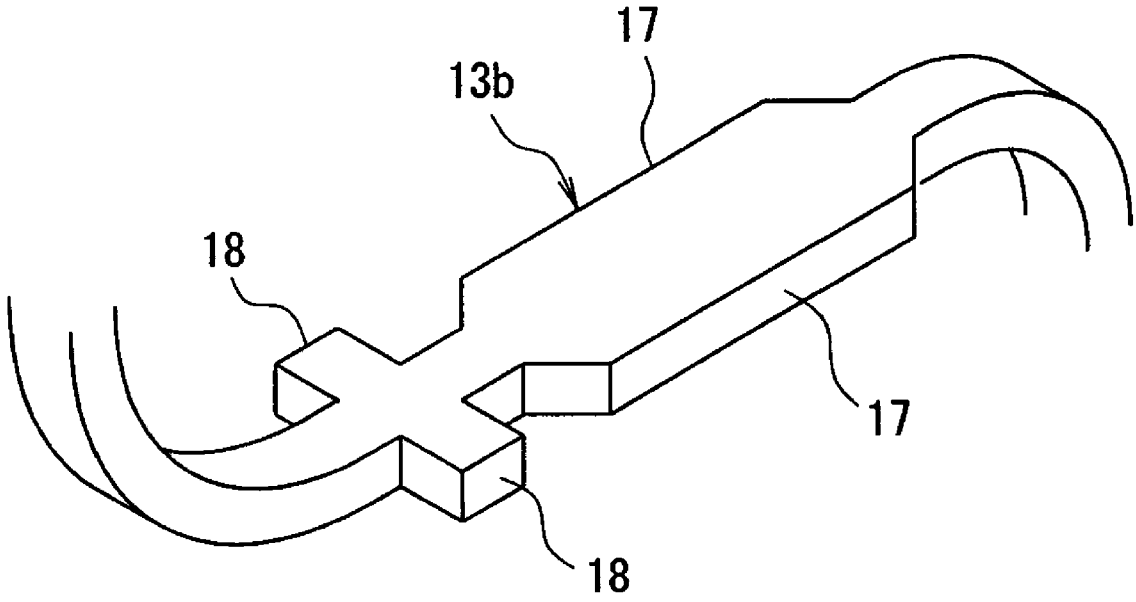
FIG. 11 is a partially enlarged perspective view of a coupling portion of a contact included in the floating connector according to the invention.

Referring now to FIG. 11, each side surface of the coupling portion 13*b*, in the flexible coupling portion 13, has a wide portion 17 having a wing-like shape that projects in the widthwise direction. Additionally, a stopper 18, which projects in the widthwise direction, is arranged at the rear side of the wide portion 17 of each side surface of the coupling portion 13*b* in the flexible coupling portion 13. In this situation, the width of both of the wide portions 17 is set so as to be inserted into each groove 51 of the impedance adjusting member 50, which will be described later. Meanwhile, the width between both of the stoppers 18 is set so that the stoppers 18 cannot be inserted into each groove 51 of the impedance adjusting member 50.

Herein, the first secured portion 11 and the contact portion 12 are included in a contact section to be mated with a mating contact, and the second secured portion 14 and the board connecting portion 15 are included in a connecting section to be connected to a circuit board, so that the flexible coupling portion 13 couples the contact section to be mated with the mating contact and the connecting section to be connected to the circuit board. The board connecting portion 15 is connected to a circuit board (not shown), whereas the mating connector (not shown) is mounted on another circuit board (not shown) vertically disposed with respect to the circuit board to which the board connecting portion 15 is connected.

As illustrated in FIG. 10, the impedance adjusting member 50 is made of a dielectric material, and is formed to have a rectangular shape that extends in the lengthwise direction (in the direction extending from the far left side to the near right side in FIG. 10). Herein, the dielectric material, according to the shown embodiment, may be any material as far as it has a sufficient dielectric constant with respect to the air, it is small in loss (what is called tan δ), and it can be processed with ease. In the embodiment shown, the impedance adjusting member 50 is made of a LCP (Liquid Crystal polymer). The bottom surface side of the impedance adjusting member 50 is provided with multiple grooves 51 into which the coupling portions 13*b* of the flexible coupling portions 13 in the respective contacts 10 are respectively inserted. The respective grooves 51 are arranged to have a given pitch there between in the lengthwise direction. Also, the respective grooves 51 are arranged at the entire length of the front-back direction of the impedance adjusting member 50. The lower ends of the respective grooves 51 are respectively provided with folded back lugs 52, which extend to oppose to each other from respective side walls. In this situation, the width between the folded back lugs 52 is configured to have a size that permits the second curved portion 13*c* of each contact 10 to pass there through, but does not permit both of the wide portions 17 of the coupling portion 13*b* to pass there through.

With reference back to FIG. 3, the movable housing 20 is provided with a movable housing main body 21 having a rectangular shape that extends in the lengthwise direction (left-right direction of FIG. 3), and is formed by molding insulating resin. Specifically, the movable housing main body 21 is provided with multiple contact securing openings 22 which are arranged at a given pitch in the lengthwise direction and into which the first secured portion 11 of the respective contacts 10 are press fit and secured, respectively. Additionally, referring back to FIG. 3, the movable housing main body 21 is provided with multiple (two in the shown embodiment) mating connector receiving passageways 22*a* and 22*b*. Each end portion in the lengthwise direction of the movable housing main body 21 is provided with a pin receiving passageway 23 that projects rearward from the movable housing main body 21 (see FIG. 6). Each pin receiving passageway 23 includes a first through-hole 26 that penetrates there through in the vertical direction (see FIG. 2).

With reference back to FIG. 6, the fixed housing 30 includes a fixed housing main body 31 having a rectangular shape that extends in the lengthwise direction (left-right direction of FIG. 3) and that is formed by molding insulating resin. Specifically, the fixed housing main body 31 is provided with multiple contact securing grooves 32, which are arranged at an identical pitch to those of the contact securing openings 22 in the lengthwise direction, and into which the second secured portion 14 of the respective contacts 10 are press fit, respectively. Additionally, the fixed housing main body 31 is provided with a flexible coupling portion receiving passageway 33*a* to communicate with a given number of contact securing grooves 32 (i.e. 15 in the shown embodiment), and a flexible coupling portion receiving passageway 33*b* to be communicated with a given number of contact securing grooves 32 (i.e. 7 in the shown embodiment). Further, a pin receiving passageway 34 is arranged at each end of the fixed housing main body 31 in the lengthwise direction.

Figure 7:
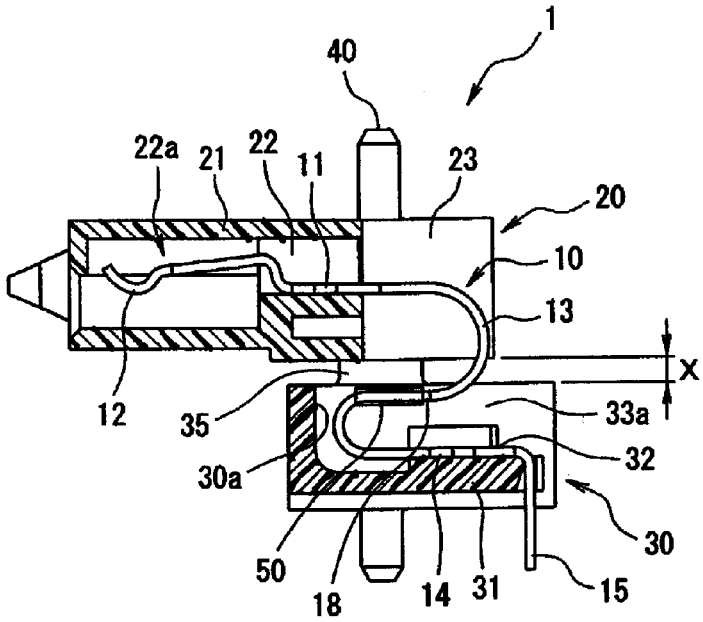
FIG. 7 is a cross-sectional view of the floating connector, taken along line 7-7 of FIG. 3.
Figure 8:
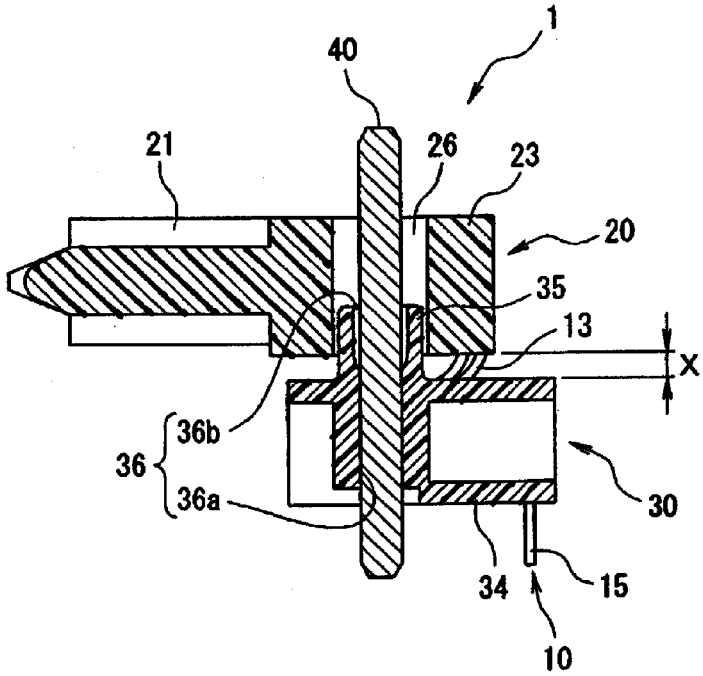
FIG. 8 is a cross-sectional view of the floating connector, taken along line 8-8 of FIG. 3.
Figure 9:
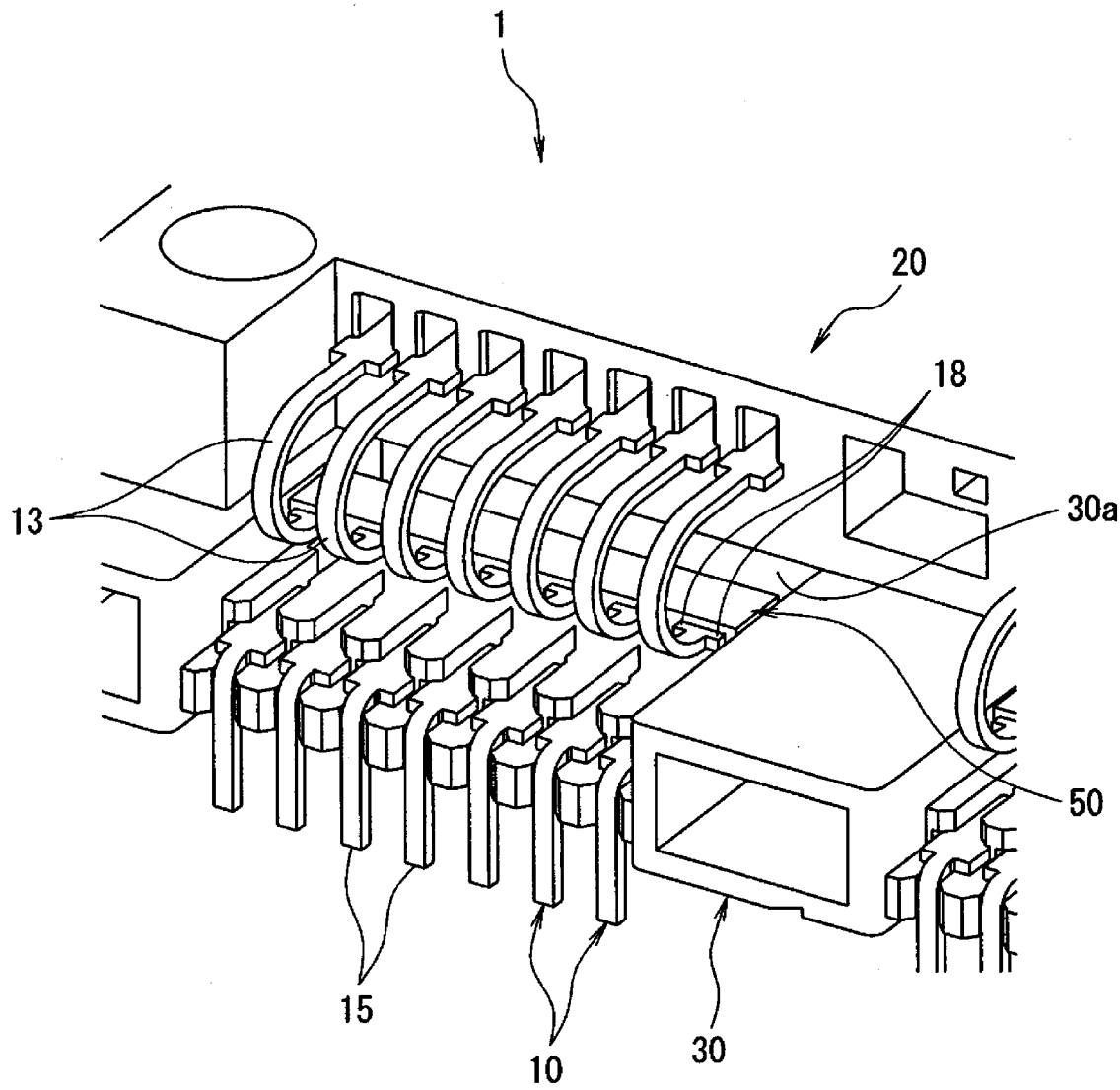
FIG. 9 is a partially enlarged perspective view of the floating connector illustrated in FIG. 1.

With reference to FIGS. 7 and 8, a tubular boss 35 that projects upward from the pin receiving passageway 34 is arranged, in each pin receiving passageway 34, at a position corresponding to the first through-hole 26. Also, a second through-hole 36 is arranged to allow both of the pin receiving passageway 34 and the tubular boss 35 to be penetrated therethrough in the vertical direction. The second through-hole 36 includes a press fitting and pin securing passageway 36*a* for press fitting and securing the pin 40, and an enlarged receiving portion 36*b* having a diameter slightly greater than that of the press fitting and pin securing passageway 36*a* and the outer diameter of the pin 40.

With reference to FIG. 8, the inner diameter of the first through-hole 26 in the movable housing 20 is designed to have a size that permits the boss 35 to be inserted there into and the movable housing 20 to move up and down with respect to the fixed housing 30. Herein, the fixed housing main body 31 and the pin receiving passageway 34 are included in the housing main body.

Each of the pin 40 is made of a cylindrical metal rod body, and metal plating such as tin plating is treated over its entire outer surface.

When the floating connector 1 is assembled, the first secured portion 11 of each contact 10 is firstly press fit and secured into each contact securing opening 22 of the movable housing 20. When the first secured portion 11 of each contact 10 is press fit and secured into each contact securing opening 22, the contact portion 12 of each contact is received in the mating connector receiving passageways 22*a* or 22*b* to extend therein. Also, when the first secured portion 11 of each contact 10 is press fit and secured into each contact securing opening 22, the flexible coupling portion 13 of each contact 10 is made in a state of projecting rearward from the movable housing main body 21.

Subsequently, the impedance adjusting member 50 is positioned at the flexible coupling portion 13, of each contact 10, that projects rearward from the movable housing main body 21. When the impedance adjusting member 50 is positioned to the flexible coupling portion 13 of each contact 10, the impedance adjusting member 50 is assembled in such a manner that both of the wide portions 17 of the coupling portion 13*b* in the flexible coupling portion 13 of each contact 10 are inserted into each groove 51 of the impedance adjusting member 50 from the front side of both of the wide portions 17 (see FIG. 10). Thus, the impedance adjusting member 50 is assembled over the flexible coupling portion 13*b* of the flexible coupling portion 13 of each contact 10 in a movable state in the font-back direction. In this manner, in the floating connector 1, when the impedance adjusting member 50 is positioned on the coupling portion 13*b* of the flexible coupling portion 13 in each contact 10, it is only necessary to cause both of the wide portions 17 of the coupling portion 13*b* in the flexible coupling portion 13 of each contact 10 to be inserted into each groove 51 of the impedance adjusting member 50, thereby allowing the impedance adjusting member 50 to be attached with ease. Then, the attachment of the impedance adjusting member 50 to the flexible coupling portion 13 of each contact 10 provides that the coupling portion 13*b* of the flexible coupling portion 13 surrounded by a dielectric material.

The second secured portion 14 of each contact 10 is press fit and secured into each contact securing groove 32 of the insulating fixed housing 30. When the second secured portion 14 of each contact 10 is press fit and secured into each contact securing groove 32, the flexible coupling portion 13 of each contact is accommodated to extend in the flexible coupling portion receiving passageways 33*a* and 33*b*. In addition, when the second secured portion 14 of each contact 10 is press fit and secured into the contact securing groove 32, the board connecting portion 15 of each contact 10 projects downward from the fixed housing main body 31. Further, the second secured portion 14 of each contact 10 is press fit and secured into each contact securing groove 32 of the fixed housing 30, thereby limiting the moving range of the impedance adjusting member 50 in the front-back direction over the coupling portion 13*b* of the flexible coupling portion 13 in each contact 10 to the range between both stoppers 18 of the coupling portion 13*b* and an inner surface 30*a* of the front wall of the fixed housing 30, as illustrated in FIG. 7. This prevents both of the wide portions 17 of the coupling portion 13*b* in the flexible coupling portion 13 of each contact 10 from dropping out of each groove 51 of the impedance adjusting member 50, thereby preventing the impedance adjusting member 50 from dropping out of the flexible coupling portion 13 of each contact 10.

Moreover, referring now to FIG. 8, each pin 40 is inserted into the first through-hole 26 of the movable housing 20 through each second through-hole 36 from the bottom side of the fixed housing 30. Thus, each pin 40 is press fit and secured into the press fitting and pin securing passageway 36*a* of the fixed housing 30. When each pin 40 is press fit and secured into the press fitting and pin securing passageway 36*a* of the fixed housing 30, an end of each pin 40 projects upward from the top surface of the movable housing 20 with each pin 40 inserted into the first through-hole 26, as illustrated in FIG. 8.

In the floating connector 1, where assembly is completed, the movable housing 20 is stacked over the fixed housing 30 with spaced apart from the insulating fixed housing 30 by a distance X, as illustrated in FIG. 1, FIG. 7, and FIG. 8. Also, the movable housing 20 is coupled to the fixed housing 30 through the flexible coupling portions 13 of the contacts 10. This enables the movable housing 20 to move in the vertical and horizontal directions with respect to the fixed housing 30 in the floating connector 1.

In the floating connector 1 where assembly is completed, the lower end of each pin 40 penetrates through a positioning opening (not illustrated) and is connected thereto by soldering arranged in a circuit board, and in addition, the board connecting portion 15 of each contact 10 is attached to a through-hole (not illustrated) arranged in the circuit board and connected thereto by soldering or mounted on the surface thereof. Thus, the floating connector 1 is mounted onto the circuit board. Also, the top end of each pin 40 fits into a positioning opening (not illustrated) provided in a chassis (not illustrated) of an electronic apparatus onto which the floating connector 1 is mounted. In this manner, the floating connector 1 is also positioned on the chassis.

When the floating connector 1 configured as described above is mated with a mating connector (not shown), mating contacts provided in the mating connector come into contact with the contact portions 12 of the contacts 10, respectively, so that the circuit board on which the mating connector is mounted and the circuit board on which the floating connector 1 is mounted are electrically conducted. If a misalignment occurs at the time of mating of both of the connectors, in particular, if a misalignment occurs in the vertical direction, the movable housing 20 moves in the vertical direction with respect to the fixed housing 30 to permit the misalignment. Additionally, even if an object or the like hits the movable housing 20 and a strong impact is applied to the movable housing 20, the flexible coupling portion 13 of the contacts 10 will absorb the impact and the impact will be attenuated. Therefore, it is possible to prevent the deformation and compromise at a solder connecting part of the board connecting portion 15.

Figure 12:
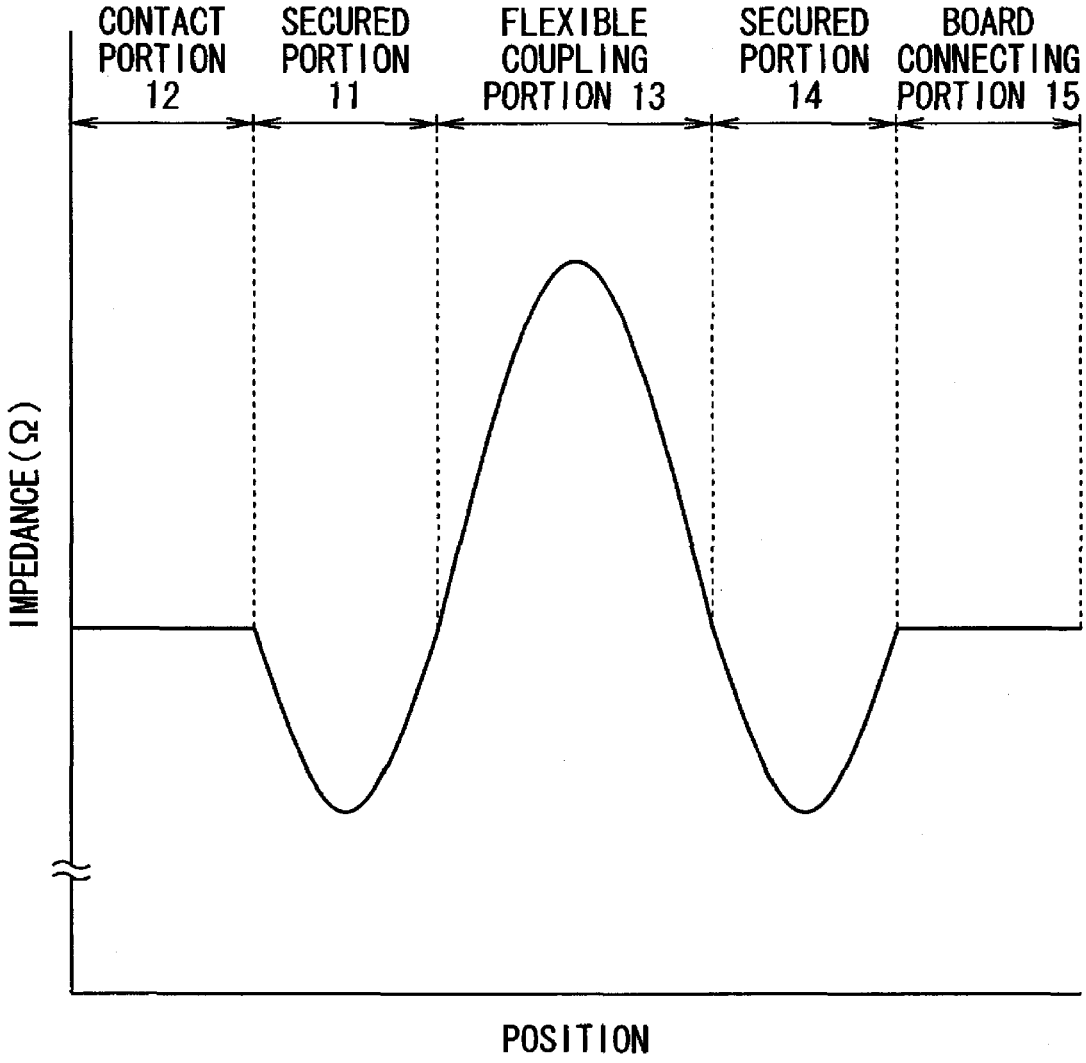
FIG. 12 is a schematic view representing the magnitude of the impedance at each position of the contact included in the floating connector according to the invention.
Figure 13:
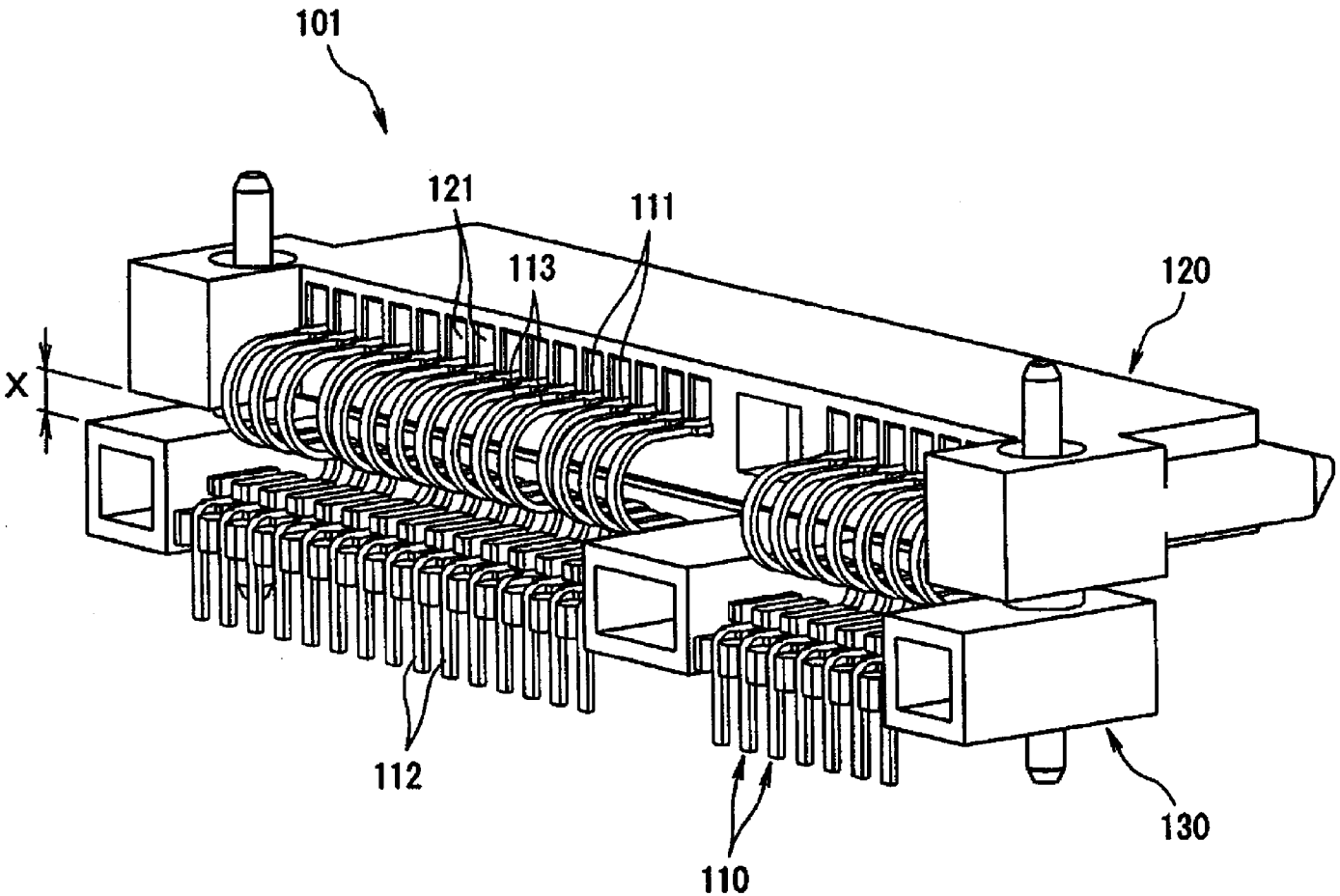
Prior Art FIG. 13
FIG. 13 is a perspective view of a conventional floating connector, when viewed from the rear side thereof.
Figure 14:
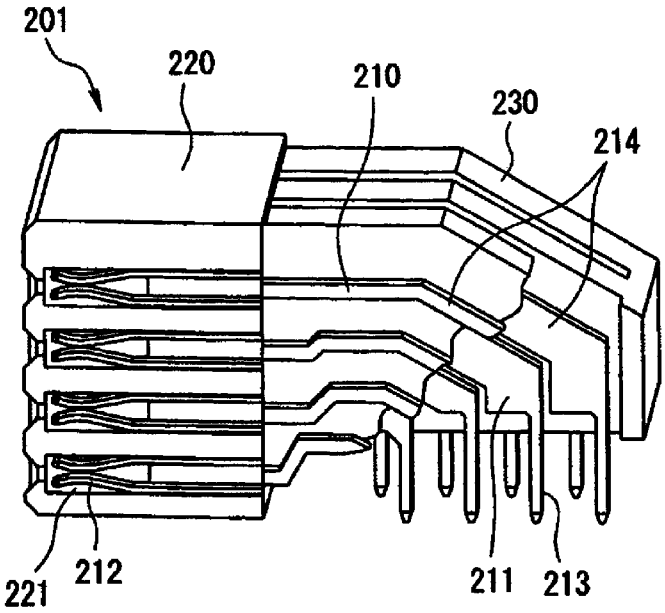
FIG. 14 is a perspective view of a conventional impedance matching connector.

In FIG. 12, the horizontal axis represents each position of the contact 10 and the vertical axis represents impedance (Ω). Herein, the impedance of each position of each contact 10 in a state where the impedance adjusting member 50 is not provided, as illustrated in FIG. 12, is low at the first secured portion 11 to be press fit and secured into each contact securing opening 22 of the movable housing 20 and the second secured portion 14 to be press fit and secured into each contact securing groove 32 of the fixed housing 30, whereas the impedance is high at the flexible coupling portion 13. Specifically, the impedance of each position of each contact 10, in the state where there the impedance adjusting member 50 is not provided, is highest, in particular, at the middle point of the flexible coupling portion 13. Incidentally, FIG. 12 is a schematic diagram comparatively depicting the change in the impedance at each position of each contact 10, and the vertical axis of FIG. 12 represents arbitrary scale. Also, the horizontal axis of FIG. 12 represents a distance from one end of each contact 10. Accordingly, the floating connector 1 employs the configuration where the impedance adjusting member 50 is arranged on the coupling portion 13*b*, which is located in the middle of the flexible coupling portion 13 of each contact 10. Thus, the coupling portion 13*b* of the flexible coupling portion 13 in each contact 10 is surrounded by a dielectric material and the impedance of the coupling portion 13*b* is made smaller, thereby permitting the impedance matching in the entire contact 10.

In a case where the target value of the impedance of the coupling portion 13*b* of the flexible coupling portion 13 in each contact 10 is set at 100±10Ω, the impedance of the coupling portion 13*b*, in the state where the impedance adjusting member 50 is not provided, is 119Ω. Meanwhile, the impedance of the coupling portion 13*b*, in a state where the impedance adjusting member 50 made of LCP is assembled, is 97Ω, which falls within the above target value. Incidentally, the dielectric constant of the LCP at 1 GHz is 3.8.

In addition, the impedance adjusting member 50 is arranged on the coupling portion 13*b* of the flexible coupling portion 13 in each contact 10, whereby the impedance adjusting member 50 is accommodated in the flexible coupling portion receiving passageways 33*a* and 33*b* of the fixed housing 30. This prevents the impedance adjusting member 50 from blocking the movement of the movable housing 20.

Furthermore, the impedance adjusting member 50 is arranged on the coupling portion 13*b* of the flexible coupling portion 13 in each contact 10, thereby permitting the respective contacts 10 to align at a given pitch. It is therefore possible to prevent the change in the impedance of each contact 10 due to the change in the pitch of each contact 10.

Herein, the impedance adjusting members 50 are made of materials with different dielectric constants, making the impedances of the respective contacts 10 different. Also, in the impedance adjusting member 50, the impedance is changeable by varying the width of the groove 51. Accordingly, multiple kinds of impedance adjusting members 50 made of materials with different dielectric constants and the impedance adjusting members 50 having different widths of the groove 51 are prepared so that the impedance of each contact 10 is adjustable to a desired value, by arbitrarily selecting the impedance adjusting member 50 to be assembled in assembling the floating connector 1.

While the embodiments of the invention have been illustrated in detail, it should be apparent that variations and modifications to those embodiments may occur.

For example, according to the embodiment shown, the impedance adjusting member 50 has a configuration where the impedance adjusting member 50 is assembled over the coupling portion 13*b* of the flexible coupling portion 13 in each contact 10 so as to be capable of moving in the front-back direction. However, the impedance adjusting member 50 may be press fit and secured into the coupling portion 13*b* of the flexible coupling portion 13 in each contact 10. Also, the impedance adjusting member 50 may be adhered or thermally fused to the coupling portion 13*b* of the flexible coupling portion 13 in each contact 10.

Also, according to the embodiment shown, the impedance adjusting member 50 is made of an LCP, but may be made of another kind of dielectric material.

In addition, according to the embodiment shown, the wide portion 17 and the stopper 18 are arranged at the coupling portion 13*b* of the flexible coupling portion 13 in each contact 10, so both of the wide portions 17 are inserted into each groove 51 of the impedance adjusting member 50. However, the configuration may be devised such that the coupling portion 13*b* is inserted into each groove 51 of the impedance adjusting member 50 without the provision of the wide portion 17 or the stopper 18 at the coupling portion 13*b* of the flexible coupling portion 13 in each contact 10.

Furthermore, according to the embodiment shown, a pair of pin 40 are employed. However, both of pin 40 may not be provided.

The invention claimed is:

1. An electrical connector comprising:

a contact having a contact portion, a board connecting portion, and a flexible coupling portion connecting the contact portion and the board connecting portion;

a movable housing configured to receive the contact portion of the contact;

a fixed housing connecting to the board connecting portion, the movable housing being tiered with respect to the fixed housing; and an impedance adjusting member, the impedance adjusting member arranged with the flexible coupling portion;

wherein the flexible coupling portion includes a first curved portion, a second curved portion, and a linear coupling portion, the second curved portion bending in a reversed direction from a direction that the first curved portion bends, the linear coupling portion connecting the first curved portion and the second curved portion;

wherein the flexible coupling portion further includes a wide portion along the linear coupling portion and has a wing-like shape that projects in a widthwise direction.

2. The electrical connector according to claim 1, wherein the impedance adjusting member has a groove in a bottom surface, into which the linear coupling portion of the flexible coupling portion is inserted.

3. The electrical connector according to claim 2, wherein a lower end of the groove has folded back portions each extending from each side wall of the groove to oppose to each other.

4. The electrical connector according to claim 2, wherein the impedance adjusting member is attached over the linear coupling portion in a moveable state in a direction that the groove extends.

5. The electrical connector according to claim 3, wherein the impedance adjusting member is attached over the linear coupling portion in a moveable state in a direction that the groove extends.

6. The electrical connector according to claim 1, wherein a width of the wide portion is set so as to be inserted into a groove of the impedance adjusting member.

7. The electrical connector according to claim 6, wherein the groove is arranged to have a given pitch therebetween in a lengthwise direction.

8. The electrical connector according to claim 7, wherein lower ends of the groove are respectively provided with folded back lugs that extend and oppose each other from respective side walls.

9. The electrical connector according to claim 6, further comprising a stopper arranged at a rear side of the wide portion of each side surface of the flexible coupling portion, the stopper projects in the widthwise direction.

10. The electrical connector according to claim 1, wherein the contact portion is configured to mate with a mating contact and the board connecting portion is configured to connect to a circuit board.

11. The electrical connector according to claim 1, wherein the impedance adjusting member is made of a dielectric material.

12. The electrical connector according to claim 1, wherein the movable housing is positioned at a given distance apart from the fixed housing.

13. An electrical connector comprising:

a contact having a contact portion, a board connecting portion, and a flexible coupling portion connecting the contact portion and the board connecting portion;

a movable housing configured to receive the contact portion of the contact;

a fixed housing connected to the board connecting portion, the movable housing being tiered with respect to the fixed housing; and an impedance adjusting member having a groove in a bottom surface, into which a linear coupling portion of the flexible coupling portion is inserted, the impedance adjusting member arranged with the flexible coupling portion;

wherein the flexible coupling portion includes a first curved portion, a second curved portion, and the linear coupling portion, the second curved portion bending in a reversed direction from a direction that the first curved portion bends, the linear coupling portion connecting the first curved portion and the second curved portion;

wherein a lower end of the groove has folded back portions each extending from each side wall of the groove to oppose to each other.

14. The electrical connector according to claim 13, wherein the impedance adjusting member is attached over the linear coupling portion in a moveable state in a direction that the groove extends.

15. The electrical connector according to claim 13, wherein the flexible coupling portion further includes a wide portion along the linear coupling portion and has a wing-like shape that projects in a widthwise direction.

16. The electrical connector according to claim 15, wherein a width of the wide portion is set so as to be inserted into the groove of the impedance adjusting member.

17. The electrical connector according to claim 16, wherein the groove is arranged to have a given pitch therebetween in a lengthwise direction.

18. The electrical connector according to claim 17, wherein lower ends of the groove are respectively provided with folded back lugs that extend and oppose each other from respective side walls.

19. The electrical connector according to claim 16, further comprising a stopper arranged at a rear side of the wide portion of each side surface of the flexible coupling portion, the stopper projects in the widthwise direction.

20. The electrical connector according to claim 13, wherein the contact portion is configured to mate with a mating contact and the board connecting portion is configured to connect to a circuit board.

21. The electrical connector according to claim 13, wherein the impedance adjusting member is made of a dielectric material.

22. The electrical connector according to claim 13, wherein the movable housing is positioned at a given distance apart from the fixed housing.

* * * * *